US007339106B2

(12) United States Patent
Tamura

(10) Patent No.: US 7,339,106 B2
(45) Date of Patent: Mar. 4, 2008

(54) ELECTRIC STRINGED MUSICAL INSTRUMENT EQUIPPED WITH SINGLE VIBRATION SENSOR PROVIDED INSIDE OF BODY

(75) Inventor: Shinya Tamura, Shizuoka-ken (JP)

(73) Assignee: Yamaha Corporation (JP)

( * ) Notice: Subject to any disclaimer, the term of this patent is extended or adjusted under 35 U.S.C. 154(b) by 200 days.

(21) Appl. No.: 11/157,786

(22) Filed: Jun. 22, 2005

(65) Prior Publication Data

US 2006/0042454 A1 Mar. 2, 2006

(30) Foreign Application Priority Data

Aug. 24, 2004 (JP) ..... 2004-243776

(51) Int. Cl.
*G10H 3/00* (2006.01)

(52) U.S. Cl. ..... 84/723; 84/725; 84/730; 84/737

(58) Field of Classification Search ..... None
See application file for complete search history.

(56) References Cited

U.S. PATENT DOCUMENTS

| | | | | |
|---|---|---|---|---|
| 4,635,523 | A | 1/1987 | Merchant | |
| 4,843,937 | A | 7/1989 | Murphy | |
| 5,123,326 | A | 6/1992 | Clevinger | |
| 5,641,932 | A | 6/1997 | Lace | |
| 5,945,622 | A * | 8/1999 | Yamada | 84/731 |
| 6,031,164 | A | 2/2000 | Murakami | |
| 6,791,023 | B2 * | 9/2004 | Nakaya | 84/736 |
| 2003/0094094 | A1 * | 5/2003 | Nakaya | 84/736 |
| 2003/0145711 | A1 * | 8/2003 | Tamura | 84/291 |
| 2004/0255762 | A1 * | 12/2004 | Takabayashi | 84/730 |
| 2005/0011342 | A1 * | 1/2005 | Fishman | 84/730 |
| 2005/0257670 | A1 * | 11/2005 | Takabayashi | 84/730 |
| 2006/0011049 | A1 * | 1/2006 | Takabayashi | 84/734 |

FOREIGN PATENT DOCUMENTS

| | | | |
|---|---|---|---|
| CH | 671 110 | * | 7/1989 |
| GB | 1236697 | | 7/1971 |
| JP | 2003-150164 | | 5/2003 |
| WO | WO-91/15844 | | 10/1991 |

* cited by examiner

*Primary Examiner*—Marlon T Fletcher
(74) *Attorney, Agent, or Firm*—Dickstein, Shapiro, LLP.

(57) ABSTRACT

An electric contrabass has a bridge structure on a body in which an inner space is defined, and the body is further formed with a slit under the bridge structure so that the lid of the body vibrates like a cantilever; a vibration sensor is provided inside the body, and has a vibration sensitive surface held in contact with the lower surface of the lid; while a player is bowing the strings, the vibrating strings excite the lid through the bridge structure, and the vibrations of the lid is converted to an electric signal through the vibration sensor; since the distance from the vibrating strings and the single vibration sensor is approximately equal, the single vibration sensor produces the electric signal without undesirable imbalance and interference.

19 Claims, 4 Drawing Sheets

ELECTRIC STRINGED MUSICAL INSTRUMENT EQUIPPED WITH SINGLE VIBRATION SENSOR PROVIDED INSIDE OF BODY

FIELD OF THE INVENTION

This invention relates to a stringed musical instrument and, more particularly, to an electric stringed musical instrument for producing electric tones from an audio signal representative of the vibrations of the strings.

DESCRIPTION OF THE RELATED ART

The electric stringed musical instrument is defined as a stringed musical instrument equipped with a vibration sensor such as, for example, a vibration-to-electric current converter. While a player is giving rise to the vibrations of the strings, the vibrating strings exerts the force on the vibration-to-electric current converter, and the converter produces the electric charges. Since the amount of electric charge is proportional to the force, the electric charge forms an electric signal expressing the vibrations. The electric signal is supplied through the sound system to the loud speakers, and the electric tones are radiated from the loud speakers. Thus, the vibration sensor is an important part of the electric stringed musical instrument.

Typical examples of the electric stringed musical instrument are disclosed in Japanese Patent Application laid-open No. 2003-150164 and U.S. Pat. No. 4,635,523. The electric stringed musical instrument disclosed in the Japanese Patent Application is referred to as "the first prior art stringed musical instrument", and the electric stringed musical instrument disclosed in the U.S. patent is referred to as "the second prior art stringed musical instrument".

The first prior art stringed musical instrument comprises a solid body, strings, a bridge and a vibration detector unit. The bridge is upright on the upper surface of the solid body. The bridge is downwardly bifurcated from the intermediate portion thereof, and has an upper arc surface. The strings are stretched over the body, and are held in contact with the upper arc surface of the bridge. The bridge has the bifurcated portion, i.e., two legs, and two vibration sensor groups are provided between the upper surface of the solid body and the lower surfaces of the legs. Each of the two vibration sensor groups has two piezoelectric converters and an insulating layer. The insulating layer is sandwiched between the piezoelectric converters, and the piezoelectric converters are held in contact with the lower surface of the leg and the upper surface of the solid body.

The second prior art stringed musical instrument aims at making the tonal quality and the feel of the strings close to those of the corresponding acoustic stringed instrument. The object is accomplished by the support bars, which are made of spruce wood. The support bars are provided between the solid-filled body of the instrument and the bridge, over which the strings extend, and are partially spaced from the solid-filled body. The spruce wood is soft, and the spaces permit the support bars to be deformed. Thus, the support bars are constructed in such a manner as to allow the bridge to vibrate freely. This results in the tonal quality and feel close to those of the corresponding acoustic instrument. However, the U.S. Patent is silent to the location of the vibration sensors.

A problem inherent in the first prior art stringed musical instrument is the tonal quality, and another problem is the feel of the strings. Yet another problem is the difference in sensitivity to the vibrations propagated from the plural strings to the vibration detector unit. Still another problem is the interference between the two vibration sensor groups.

The poor tonal quality and poor feel of strings are derived from influence of the solid body. The solid body is larger in rigidity than the hollow body of the corresponding acoustic musical instrument, and is less deformed during the vibrations of the strings. As a result, the electric tones contain high-frequency components more than those of the tones produced through the corresponding acoustic stringed musical instrument, and the player feels the vibrating strings different from those of the corresponding acoustic stringed musical instrument.

The imbalance in sensitivity is derived from the difference in distance between the vibrating strings and the vibration detector unit. As similar to the bridge of the corresponding acoustic stringed musical instrument, the bridge, which is incorporated in the first prior art stringed musical instrument, has the upper arc surface, and the strings are held in contact with the upper arc surface. This means that the vibrating strings exert the force on the upper arc surface. Although the upper arc surface gives the favorable impression, that is the similar impression to that received from the corresponding stringed musical instrument, to the users, the upper arc surface makes the distance from the plural strings to the vibration detector unit different. Since the vibrations are propagated to the vibration detector unit over the different distance, the vibrations propagated from a string are decayed differently from the vibrations propagated from another string. This results in the electric tones unintentionally different in loudness.

The interference between the two sensor groups is due to the shape of the bridge. The lower portion of the bridge is bifurcated so that the bridge is held in contact at both feet with the upper surface of the solid body. If only one vibration sensor is provided between one of the feet and the upper surface of the solid body, the vibration sensor can not exactly convert the vibrations to the electric signal. The two sensor groups are preferable to the only one sensor from the viewpoint of the fidelity. However, the two sensors independently produce the electric charge. The electric charge output from one sensor group is liable to interfere with the electric charge output from the other sensor group. This results in missing tones and poor tonal quality.

The tonal quality and feel of strings may be fairly improved by means of the support bars incorporated in the second prior art stringed musical instrument. However, two extra parts are required for the second prior art stringed musical instrument. This results in increase of the production cost. Moreover, the support bars push up the bridge and, accordingly, the strings so that the player feels the strings unaccustomed. Thus, the support bars bring new problems upon the users.

Even if the support bars are employed in the first prior art stringed musical instrument, the users suffer from at least the imbalance in sensitivity and interference.

SUMMARY OF THE INVENTION

It is therefore an important object of the present invention to provide an electric stringed musical instrument, through which electric tones are produced in good tonal quality and in good feel of strings.

To accomplish the object, the present invention proposes to form an inner space inside a body structure so as to permit a vibratory portion of the body structure widely to vibrate.

In accordance with one aspect of the present invention, there is provided an electric stringed musical instrument for producing electric tones comprising a musical instrument including a body structure formed with an inner space and having a vibratory portion partially defining the inner space, a bridge structure standing on the vibratory portion and plural strings stretched over the body across the bridge structure and independently exciting the bridge structure during vibrations thereof, and an electric system including a vibration sensor connected to the body structure and monitoring the vibratory portion so as to produce an electric signal representative of the vibrations.

BRIEF DESCRIPTION OF THE DRAWINGS

The features and advantages of the electric stringed musical instrument will be more clearly understood from the following description taken in conjunction with the accompanying drawings, in which.

DESCRIPTION OF THE PREFERRED EMBODIMENTS

In the following description, term "rear" is indicative of a position closer to the foot of FIG. 1 than a position modified with term "front", and a line drawn between a rear position and a corresponding front position extends in "fore-and-aft direction". Term "lower" is indicative of a position closer to the foot of FIG. 3 than a position modified with term "upper", and a line drawn between a lower position and a corresponding upper position extends in "up-and-down direction". "Right" and "left" are determined in FIG. 3, and term "lateral direction" crosses the longitudinal direction and up-and-down direction at right angle.

First Embodiment

Figure 1:
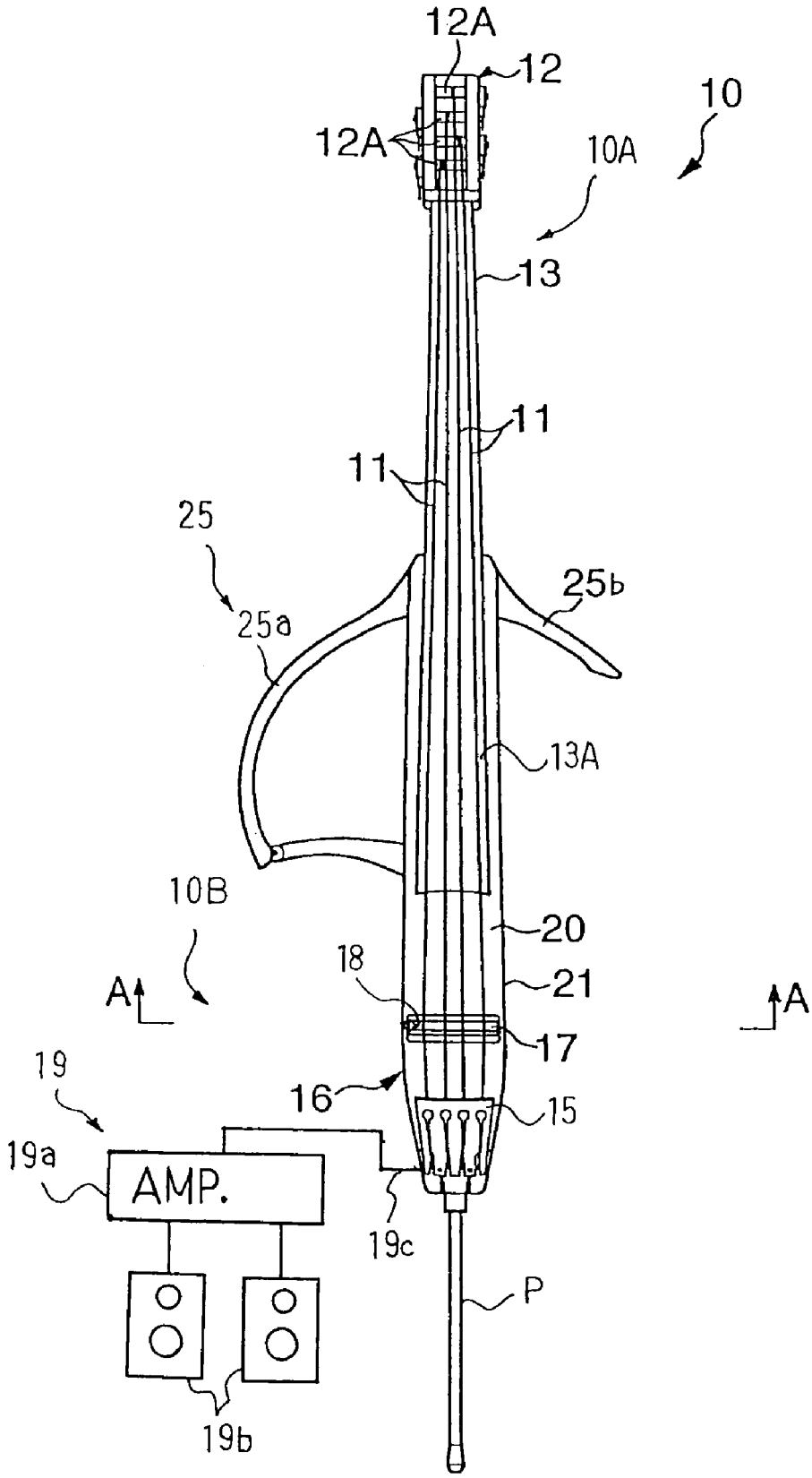
FIG. 1 is a plane view showing the configuration of an electric stringed musical instrument according to the present invention.
Figure 2:
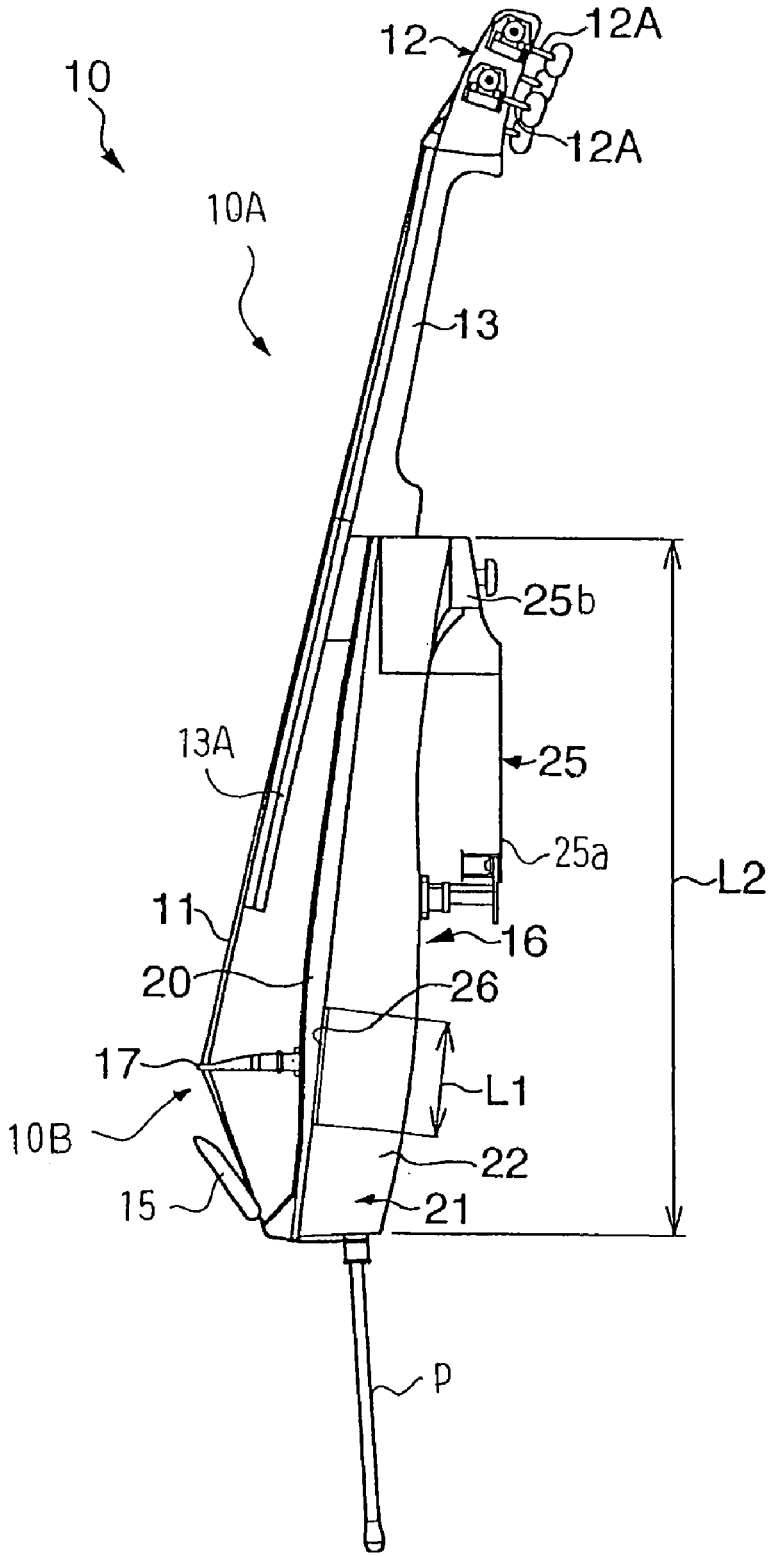
FIG. 2 is a side view showing the configuration of the electric stringed musical instrument from another angle.

Referring to FIGS. 1 and 2 of the drawings, an electric stringed musical instrument 10 embodying the present invention largely comprises a musical instrument 10A and an electric system 10B. A player simulates acoustic tones of a contrabass through bowing on the electric stringed musical instrument 10. For this reason, the electric stringed musical instrument 10 is hereinafter referred to as an "electric contrabass".

A player gives rise to vibrations in the musical instrument 10A through the bowing and plucking, and the electric system 10B converts the vibrations to an electric signal, which in turn is converted to electric tones. Thus, the electric system 10B cooperates with the musical instrument 10A so as to produce the electric tones.

Musical Instrument

The musical instrument 10A includes four strings 11, a peg box 12, a neck 13, a finger board 13A, a tailpiece 15, a body 16, a bridge structure 17, a frame structure 25 and an end pin P. The neck 13 forwardly projects from the front end surface of the body 16, and the peg box 12 is attached to the leading end of the neck 13. The frame structure 25 sidewardly projects from the body 16, and is gently curved. The frame structure 25 has a contour analogous to a part of the outline of the body of the acoustic contrabass. While a player is bowing on the electric contrabass 1, the frame structure 25 is held in contact with the chest of the player, and keeps the electric contrabass 10 stable. The end pin P is projectable from and retractable into the body 16. The end pin P is fixed to a proper length during the performance, and keeps the body 16 over a floor.

In this instance, the frame structure 25 has a foldable frame 25*a* and a fixed frame 25*b*. Although the fixed frame 25*b* does not change the relative position with respect to the body 16, the foldable frame 25*a* is projectable from and retractable into the space at the back of the body 15. The foldable frame 25*a* is broken down into two parts. The two parts are connected to each other by a pin, and are further connected at the other ends thereof to the body 16. The pins permit the two parts to be folded together and sidewardly stretched. Thus, the pins make the foldable frame 25*a* projectable from and retractable into the space at the back of the body 16.

While a player is playing a piece of music on the electric contrabass 10, the foldable frame 25*a* keeps itself on the left side of the body 16 as shown in FIG. 1. However, when the player puts the electric contrabass 10 in a bag, he or she retracts the foldable frame 25*a* into the space at the back of the body 16. Thus, the foldable frame 25*a* enhances the portability of the electric contrabass 10.

Four pegs 12A are rotatably supported by the peg box 12, and laterally extend across the inner space of the peg box 12. The finger board 13A is secured to the upper surface of the neck 13, and the rear portion of the finger board 13A rearwardly overhangs the body 16. The tailpiece 15 is connected to the rear end of the body 16, and projects over the rear portion of the body 16. The bridge structure 17 is upright on the body 16, and is located between the rear end of the finger board 13A and the front end of the tailpiece 15. The strings 4 are stretched between the pegs 12A and the tailpiece 15. The strings extend over the fingerboard 13A and the upper surface of the body 16 across the bridge structure 17. The bridge structure 17 keeps the strings 11 spaced from the upper surface of the finger board 13A as well as from the upper surface of the body 16.

While a player is playing a piece of music on the electric contrabass 10, he or she bows the strings 11 between the rear end of the fingerboard 13A and the bridge structure 17, and selectively presses the strings 11 down on the finger board 13A. The bow gives rise to the vibrations of the strings 11, and the strings 11 vibrate at the frequency depending upon the length between the tailpiece 15 and the upper surface where the strings 11 are pressed down, thickness of the strings 11 and tension exerted on the strings 11.

Figure 3:
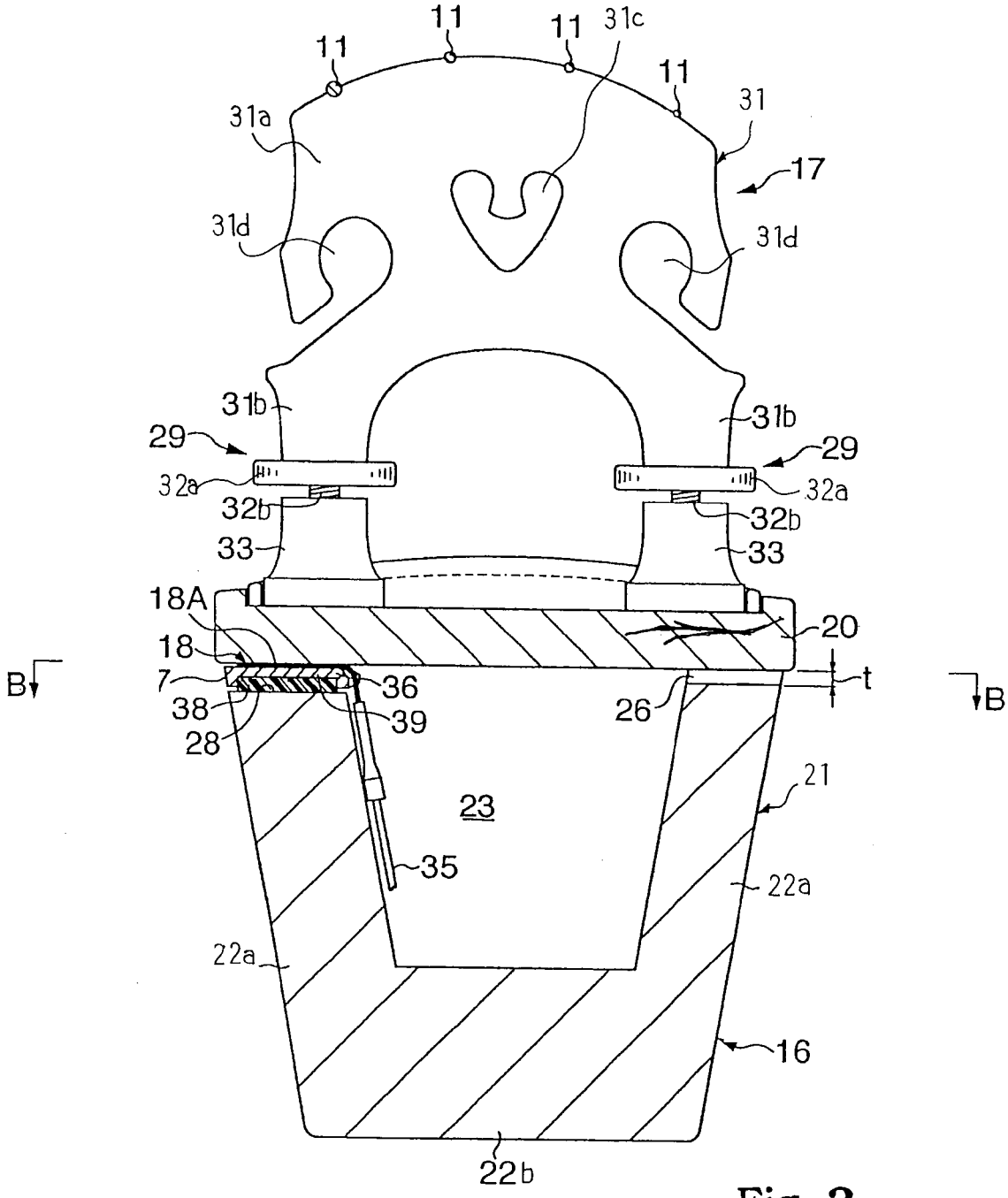
FIG. 3 is a cross sectional view taken along line A-A of FIG. 1 and showing the location of a vibration sensor with respect to a bridge.

The body 16 is long and narrow, and is formed with a hollow space 23 as shown in FIG. 3. In detail, the body 16 is broken down into a lid 20 and a tub 21. The tub 21 has an upper opening, and the upper opening is closed with the lid 20. In this instance, the lid 20 is adhered to the tub 21.

The tub 21 has a pair of side wall portions 22*a*, a pair of end wall portions (not shown) and a bottom portion 22*b*. The side wall portions 22*a* are merged with both sides of the bottom portion 22*b*, and are spaced from each other. Similarly, the end wall portions are merged with both ends of the bottom portion 22*b*, and are spaced from each other. The right side wall portion 22*a* is partially cut away so that a dent takes place.

The lid 20 is adhered to the upper surfaces of the side wall portions 22*a* and the upper surfaces of the end wall portions (not shown) so that the inner space 23 is defined by the lid 20 and tub 21. In this instance, the thickness of the lid 20 is fallen within the range between 10 millimeters and 26 millimeters. The lid 20 is spaced from the depressed upper surface, which serves as the bottom of the dent, and defines a slit 26 together with the tub 21. As a result, the inner space 23 is open to the outside through the slit 26. The slit 26 permits the vibrations to deform the lid 20, and is located in such a manner that the bridge structure 17 is on the mid point of the slit 26.

The slit 26 has the length L1, and the body 16 has the length L2. The ratio between the length L1 and the length L2 is preferably fallen within the range between 10% and 40%. When the ratio is varied, the lid 20 exhibits a deflection curve different from that of the lid at the previous ratio. For this reason, the ratio is to be adjusted to an optimum value at which the total quality becomes close to that of the acoustic contrabass. In this instance, the length L2 is of the order of 800 millimeters so that the slit 26 is to be fallen within the range from 80 millimeters to 320 millimeters. In this instance, the slit 26 is adjusted to 150 millimeters.

The height of the slit 26 is to be greater than the maximum deflection due to the tension of the strings 11. In this instance, the height of slit 26 is of the order of 3 millimeters. Thus, the slit 26 measures 150 millimeters by 3 millimeters.

The lid 20 is made of soft wood such as, for example, spruce. The persons skilled in the art are familiar with the spruce, because the manufacturer machines the spruce plates and spruce bars into various component parts of musical instruments. The spruce has the specific weight of the order of 0.4. While the vibrations are propagated from the bridge structure 17 through the lid 20 to the tub 21, the high frequency vibration components are partially filtered during the propagation through the lid 20 so that the tonal quality is improved.

The tub 21 is further formed with an acceptor 28. As will be better seen in FIG. 4, another dent serves as the acceptor 28, and is open to the inner space 23 as well as to the outside of the tub 21. The acceptor 28 is located at a predetermined position under the bridge structure 17, and, accordingly, is opposite to the middle portion of the slit 26. Although most of the dent or the acceptor 28 is constant in the fore-and-aft direction, the acceptor 28 is flared toward the outside, and the flared portion 28A will be described in conduction with a vibration sensor.

Turning back to FIG. 3, the bridge structure 17 is provided between the strings 11 and the lid 20 of the body 16, and the vibrations are propagated from the vibrating strings through the bridge structure 17 to the body 16.

The bridge structure 17 includes a pair of adjusters 29, a bridge plate 31 and a pair of foundation blocks 33. The foundation blocks 33 are respectively located over the slit 26 and acceptor 28, and are held in contact with the lid 20. The bridge plate 31 has an upper portion 31*a* and a pair of leg portions 31*b*. A hole 31*c* is formed in the central area of the upper portion 31*a*, and the pair of leg portions 31*b* is bifurcated from the upper portion 31*a*. Since both side portions are partially cut away from the upper portion 31*a* like inlets 31*d*, the boundary between the upper portion 31*a* and the leg portions 31*b* is constricted, and permits the vibrating strings 11 to shake the upper portion 31*a*.

Figure 4:
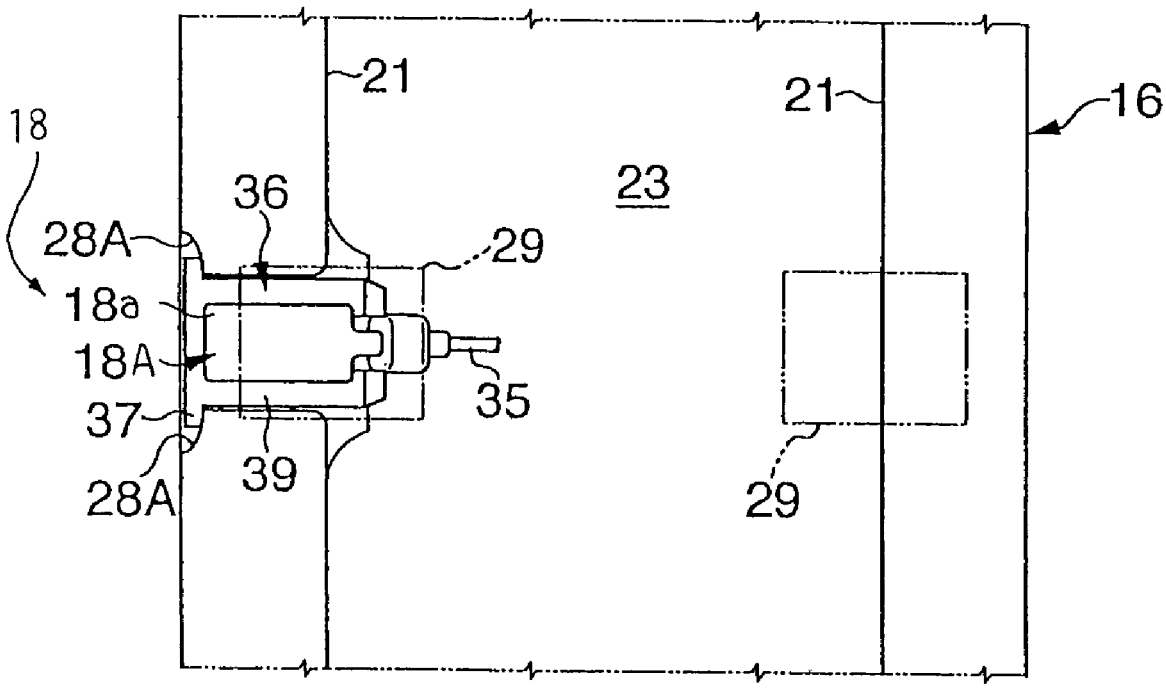
FIG. 4 is a plane view taken along line B-B of FIG. 3 and showing an acceptor for the vibration sensor.

The adjusters 29 are located over the acceptor 28 and the middle portion of the slit 26 as will be seen in FIG. 4, and, accordingly, the leg portions 31*b* are also located the acceptor 28 and the middle portion of the slit 26. The adjusters 29 are provided between the leg portions 31*b* and the foundation blocks 33, respectively, and each of the adjusters 29 has a wheel 32*a* and a threaded stem 32*b*. The threaded stems 32*b* are inserted at the lower ends thereof into the foundation blocks 33 and at the upper ends thereof into the leg portions 31*b*. Threaded holes are formed in the central areas of the wheels 32*a*, and the threaded stems 32*b* are held in meshing engagement with the wheels 32*a*. While a user is rotating the wheels 32*a* with the fingers in a certain direction, the wheels 32*a* push the bridge plate 31 upwardly, and the bridge plate 31 spaces the strings from the lid 20. On the other hand, while the user is rotating the wheels 32*a* in the opposite direction, the wheels 32*a* get close to the foundation blocks 33, and the bridge 31 lowers the strings 11 from the previous positions. Thus, the user can vary the height of the strings 11 by means of the adjusters 29.

While a player is bowing on the strings 11 and plucking the strings 11, the vibrating strings 11 excite the bridge plate 31, and the bridge plate 31 not only vibrates but also is shaken. The vibrations and shakes are propagated through the foundation blocks 33 to the lid 20 so that the lid 20 is excited.

Since the inner space 23 does not restrict the lid 20, the lid 20 freely vibrates, and the slit 26 permits the right side portion of the lid 20 widely to vibrate. In other words, the slit 26 makes the right side portion of the lid 20 serve as a free end, and the left side portion of the lid 20 serves as a fixed end. As a result, the vibrations produce large bending moment exerted on the right side portion of the lid 20.

The force is always exerted at the foundation blocks 33 on the lid 20, and gives rise to the vibrations of the lid 20. When the leftmost string 11 vibrates, the vibrations are propagated from the foundation blocks 33 to the lid 20. Even when the other strings 11 vibrate, the vibrations are also transferred from the foundation blocks 33 to the lid 20.

Electric System

Turning back to FIG. 1, the electric system 10B includes a single vibration sensor 18 and a sound system 19, i.e., amplifiers 19*a* and loud speakers 19*b*. The single vibration sensor 18 is connected to the amplifiers 19*a* through a cable 19*c*, and the electric signal is equalized and amplified through the amplifiers 19*a*. One of the amplifiers 19*a*, i.e., the power amplifier is connected through cables to the loud speakers 19*b*, and the electric signal is supplied from the power amplifier to the loud speakers 19*b*. As a result, the electric signal is converted through the loud speakers 19*b* to the electric tones, and the electric tones are radiated from the loud speakers 19*b*.

Referring to FIGS. 3 and 4, again, the vibration sensor 18 includes a piezoelectric converter 18A, a shield cable 35, a sensor holder 36 and a resilient plate 38. The piezoelectric converter 18A is mounded on the sensor holder 36, and is sandwiched between the sensor holder 36 and the lower surface of the lid 20. The shield cable 35 is connected at one end thereof to the piezoelectric converter 18A and at the other end thereof to a suitable socket, which is exposed to the outside, and a jack, which is provided at one end of the cable 19*c*, is inserted into the socket. The shield cable 35 extends through the inner space 23 to the socket.

The piezoelectric converter 18A is sensitive at the upper surface 18*a* thereof to the vibrations so that the vibrating lid 20 repeatedly exerts the force on the upper surface 18*a*. The force repeatedly gives rise to the strain of the piezoelectric crystal, which forms the essential part of the piezoelectric converter 18A, and the electric charge is taken out from the piezoelectric converter 18A to the shield cable 35.

The sensor holder 36 includes a plate portion 39 and a flange portion 37. The flange portion 37 sidewardly projects from both sides of the plate portion 39. The flange portion 37 is narrower than the flared portion 28A, and is wider than the remaining portion of the acceptor 28. The flange portion 37 is directed in the fore-and-aft direction, and the sensor holder 36 is inserted into the acceptor 28. The flange portion 37 is brought into contact with the inner surfaces, which define the flared portion 28A, and is received in the flared portion 28A. The plate portion 39 is snugly received in the remaining portion of the acceptor 28, and projects into the inner space 23. The piezoelectric converter 18A is mounted on the upper surface of the plate portion 39, and the lower surface of the plate portion 39 is partially retracted so as to form a recess, and the resilient plate 38 is received in the recess. The resilient plate 38 is pressed on the upper surface of the left side wall portion 22*a*, and urges the piezoelectric converter 18A to the lower surface of the lip 20. Thus, the resilient plate 38 keeps the sensitive surface 18*a* held in contact with the lid 20.

While the player is bowing on the strings 11 and sometimes plucking them, the vibrating strings 11 excite the lid 20 through the bridge structure 17, and the inner space 23 and slit 26 permit the lid 20 widely to vibrate. The vibrating lid 20 exerts the large bending moment on the piezoelectric converter 18A beneath the right side portion of the lid 20, and the piezoelectric converter 18A produces the electric charge equivalent to the strain of the piezoelectric crystal. The electric charge is taken out from the piezoelectric converter 18A, and flows through the shield cable 35 to the socket (not shown) as the electric signal.

The player is assumed to give rise to the vibrations on the leftmost string 11 or leftmost string 11. The vibrations are transferred from the vibrating bridge plate 31 through the foundation blocks 33 to the lid 20, and reach the piezoelectric converter 18A through the lid 20. When the center strings 11 vibrate, the vibrations are also transferred from the vibrating bridge plate 31 through the foundation blocks 33 to the lid 20, and reach the piezoelectric converter 18A through the lid 20. Although the propagation paths from the rightmost string/leftmost string 1 to the foundation blocks 33 are slightly different from the propagation paths from the center strings 11 to the foundation blocks 11, the distance between the foundation blocks 33 and the piezoelectric converter 18A is constant regardless of the location of the vibrating string 11. For this reason, the difference between the propagation paths is ignoreable so that the electric tones are always produced at the loudness proportional to the force exerted on the strings 11.

As will be appreciated from the foregoing description, the inner space 23 permits the lid 20 widely to vibrate, and the vibration propagating path is equalized from the plural strings 11 to the single vibration sensor 18. As a result, the single vibration sensor 18 converts the vibrations of the lid 20 to the electric signal without the imbalance and interference. Moreover, the high-frequency components are not strongly introduced in the electric signal. This results in mild tones like the acoustic tones.

The slit 26 makes the part of the lid 20 beneath the bridge structure 17 serve as a cantilever. For this reason, while the lid 20 is vibrating, large bending moment is exerted on the vibration converter 18 so that the electric signal widely swings the amplitude thereof. Thus, the slit 16 is desirable for the electric stringed musical instrument.

The relative location between the bridge structure 17 and the vibration sensor 18A is further conducive to the wide amplitude of the electric signal. Moreover, the shield cable 35 extends inside the body 16 so that the external appearance of the electric stringed musical instrument is simple.

The vibration sensor 18 is held in contact with the lower surface of the lid 20, and is spaced from the bridge structure 17. This feature is advantageous, because the user can replace the strings without disassembling the vibration sensor 17.

Although the particular embodiment of the present invention has been shown and described, it will be apparent to those skilled in the art that various changes and modifications may be made without departing from the spirit and scope of the present invention.

For example, the component parts of the electric stringed musical instrument may be differently named, and different shapes may be given thereto.

The separate-type electric stringed musical instrument does not set any limit to the technical scope of the present invention, because the electric system 10B may be built in the musical instrument. The electric stringed musical instrument with the built-in electric system is portable rather than the separate-type electric stringed musical instrument.

The present invention may appertain to other members of the violin family, i.e., the violin, viola and cello. An electric contrabass may have the length of the order of 1100 millimeters. Moreover, the present invention may be applied to plucked stringed musical instrument such as, for example, guitars and mandolins. Thus, the electric contrabass does not set any limit to the technical scope of the present invention.

Although the slit 26 is desirable, any slit is not formed between the tub 21 and the lid 20, because the manufacturer can optimize the dimensions of the lid 20 for the vibrations. Another slit may be further formed on the left side of the lid 20.

The piezoelectric converter does not set any limit to the technical scope of the present invention. The Wheatstone bridge may be used as the vibration sensor. Otherwise, a photo reflector may serve as the vibration sensor.

The sensor holder 36 may be eliminated from the vibration sensor 17. In this instance, the resilient plate 38 is directly held in contact with the piezoelectric converter 18A so as to press it to the lower surface of the lid 20. The resilient plate 38 may be replaced with a leaf spring. Otherwise, the piezoelectric converter 18A may be adhered to the lower surface of the lid 20.

The vibration sensor 18 may be provided on the lid 20 for converting the vibrations to the electric signal.

The following component parts are correlated with claim languages. The body 16, neck 13, fingerboard 13A, peg box 12 and tailpiece 15 as a whole constitute a "body structure".

What is claimed is:

1. An electric stringed musical instrument for producing electric tones, comprising;

a musical instrument including a body structure formed with an inner space and having a vibratory portion partially defining said inner space said body structure allowing a of vibratory portion to vibrate widely relative to a remaining portion of said virbratory portion, a bridge structure standing on a surface said vibratory portion, and plural strings stretched over said body structure across said bridge structure and independently exciting said bridge structure during vibrations thereof, and an electric system including only a single vibration sensor connected to another surface of said vibration portion reverse to said surface and monitoring said part of said vibratory portion so as to produce an electric signal representative of said vibrations and supplied to a sound system, where said sound system produces said electric tones as a function of said electric signal.

2. The electric stringed musical instrument as set forth in claim 1, in which said body structure is formed with a slit so as to permit said part of said vibratory portion widely to vibrate, and said vibration sensor monitors said part of said vibratory portion so as to produce said electric signal.

3. The electric stringed musical instrument as set forth in claim 2, in which said vibration sensor includes a piezoelectric converter held in contact with said part of said vibratory portion.

4. The electric stringed musical instrument as set forth in claim 1, in which said body structure includes a body having side wall portions spaced from each other on a bottom portion and an upper portion connected to said side wall portions so as to define said inner space together with saw side wall portions and said bottom portion, and a part of said upper portion serves as said vibratory portion.

5. The electric stringed musical instrument as set forth in claim 4, in which said vibration sensor is provided between one of said side wall portions and said upper portion.

6. The electric stringed musical instrument as set forth in claim 5, in which said body structure is formed with a slit between the other of said side wall portions and said upper portion, said slit being located at a certain position opposite to said vibration sensor.

7. The electric, stringed musical instrument as set forth in claim 6, in which said vibration sensor has a piezoelectric converter held in contact with said part of said upper portion.

8. The electric stringed musical instrument as set forth in claim 4, in which said upper portion is made of softwood.

9. The electric stringed musical instrument as set forth in claim 8, in which said softwood is spruce.

10. The electric stringed musical instrument as set forth in claim 6, in which a ratio in length between said slit and said body is fallen within a range between 10 percent and 40 percent.

11. The electric stringed musical instrument as set forth in claim 1, in which said bridge structure has leg portions, and said vibration sensor is located below one of said leg portions.

12. The electric stringed musical instrument as set forth in claim 11, in which said body structure is formed with a slit so as to permit said part of said vibratory portion widely to vibrate, and said slit is located below the other of said leg portions.

13. The electric stringed musical instrument as set forth in claim 11, in which said bridge structure further has a pair of foundation blocks held in contact with said vibratory portion and a pair of adjusters respectively provided between said foundation blocks and said leg portions so as to vary the space therebetween.

14. The electric stringed musical instrument as set forth in claim 13, in which said vibration sensor is held in contact with said surface of said vibratory portion reverse to the surface held in contact with one of said foundation blocks.

15. The electric stringed musical instrument as set forth in claim 14, wherein a slit is formed between said surface of said vibratory portion reverse to said surface held in contact with the other of said foundation blocks and said remaining portion of said body structure.

16. The electric stringed musical instrument as set forth in claim 14, in which said vibration sensor includes a vibration-to-electric signal converter and a resilient member urging said vibration-to-electric signal converter to said surface of said vibratory portion.

17. The electric stringed musical instrument as set forth in claim 1, in which said sound system is separated from said musical instrument so that a cable is connected between said vibration sensor and said sound system.

18. The electric stringed musical instrument as set forth in claim 17, in which said cable includes an inner cable extending in said inner since to a boundary between said inner space and the outside of said musical instrument and an outer cable connected at one end thereof to said inner cable and at the other end thereof to said sound system.

19. An electric stringed musical instrument for producing electric tones, comprising:

a musical instrument including a body structure formed with an inner space and having a vibratory portion partially defining said inner space and having a slit so as to permit a part of said vibratory portion to vibrate widely relative to a remaining portion of said vibratory portion, a bridge structure standing on a surface of said vibratory portion, and plural strings stretched over said body structure across said bridge structure and independently exciting said bridge structure during vibrations thereof; and an electric system including a vibration sensor connected to another surface of said vibratory portion reverse to said surface and monitoring said part of said vibratory portion so as to produce an electric signal representative of said vibrations.

* * * * *